US010086603B2

(12) United States Patent
Kobayashi et al.

(10) Patent No.: US 10,086,603 B2
(45) Date of Patent: Oct. 2, 2018

(54) IMAGE PROCESSING METHOD, IMAGE PROCESSING APPARATUS, AND NON-TRANSITORY COMPUTER-READABLE MEDIUM

(71) Applicants: Yoshitomo Kobayashi, Tokyo (JP); Hiroaki Sagae, Tokyo (JP)

(72) Inventors: Yoshitomo Kobayashi, Tokyo (JP); Hiroaki Sagae, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/409,772

(22) Filed: Jan. 19, 2017

(65) Prior Publication Data

US 2017/0217158 A1 Aug. 3, 2017

(30) Foreign Application Priority Data

Feb. 2, 2016 (JP) ..... 2016-018308

(51) Int. Cl.
*B41J 2/21* (2006.01)
*B41J 2/045* (2006.01)
*B41J 2/205* (2006.01)

(52) U.S. Cl.
CPC ..... *B41J 2/0451* (2013.01); *B41J 2/04586* (2013.01); *B41J 2/205* (2013.01); *B41J 2/2139* (2013.01)

(58) Field of Classification Search
CPC ..... B41J 2/0451; B41J 2/04586; B41J 2/2139
See application file for complete search history.

(56) References Cited

U.S. PATENT DOCUMENTS

2004/0252148 A1* 12/2004 Shibata ..... B41J 2/2139 347/14
2016/0277635 A1 9/2016 Kobayashi

FOREIGN PATENT DOCUMENTS

JP 2004-202794 7/2004

* cited by examiner

*Primary Examiner* — Sharon A Polk
(74) *Attorney, Agent, or Firm* — Oblon, McCleland, Maier & Neustadt, L.L.P.

(57) ABSTRACT

A method is for processing image data for recording by an image forming apparatus that discharges ink droplets from a plurality of nozzles. The method includes reading out image data corresponding to one line constituted by a series of dots aligning in a main scanning direction. The method further includes calculating a faulty discharge error, which occurs at a non-discharge position on a line at which no ink droplet is discharged from a defective one of the plurality of nozzles. The method further includes controlling distribution of the faulty discharge error to a line that is downstream relative to a line on which the non-discharge position occurs according to a limit setting that limits distribution of the faulty discharge error.

7 Claims, 5 Drawing Sheets

FIG. 4
RELATED ART

| LINE NUMBER | STATE | ERROR TO BE DISTRIBUTED |
|---|---|---|
| 1 | DISCHARGE LINE | COLOR QUANTIZATION ERROR |
| 2 | DISCHARGE LINE | COLOR QUANTIZATION ERROR |
| 3 | DISCHARGE LINE | COLOR QUANTIZATION ERROR |
| 4 | DISCHARGE LINE | COLOR QUANTIZATION ERROR |
| 5 | DEFECTIVE LINE | NO ERROR OR LARGE ERROR |
| 6 | DISCHARGE LINE | LARGE ERROR |
| 7 | DISCHARGE LINE | LARGE ERROR |
| 8 | DISCHARGE LINE | LARGE ERROR |
| 9 | DISCHARGE LINE | LARGE ERROR |

FIG. 5

| LINE NUMBER | STATE | ERROR TO BE DISTRIBUTED |
|---|---|---|
| 1 | DISCHARGE LINE | COLOR QUANTIZATION ERROR |
| 2 | DISCHARGE LINE | COLOR QUANTIZATION ERROR |
| 3 | DISCHARGE LINE | COLOR QUANTIZATION ERROR |
| 4 | DISCHARGE LINE | COLOR QUANTIZATION ERROR |
| 5 | DEFECTIVE LINE | NO ERROR OR LARGE ERROR |
| 6 | DISCHARGE LINE | LARGE ERROR |
| 7 | DISCHARGE LINE | COLOR QUANTIZATION ERROR |
| 8 | DISCHARGE LINE | COLOR QUANTIZATION ERROR |
| 9 | DISCHARGE LINE | COLOR QUANTIZATION ERROR |

IMAGE PROCESSING METHOD, IMAGE PROCESSING APPARATUS, AND NON-TRANSITORY COMPUTER-READABLE MEDIUM

CROSS-REFERENCE TO RELATED APPLICATIONS

This patent application is based on and claims priority pursuant to 35 U.S.C. § 119(a) to Japanese Patent Application No. 2016-018308, filed on Feb. 2, 2016 in the Japan Patent Office, the entire disclosure of which is hereby incorporated by reference herein.

BACKGROUND

Technical Field

The present disclosure relates to a method of processing an image data, an image processing apparatus, and a non-transitory computer-readable medium.

Description of the Related Art

An inkjet printer is a type of image forming apparatuses that discharges (jets) ink droplets onto a recording medium such as paper to form an image. Inkjet printers include a recording head having a plurality of nozzles from which ink droplets are discharged.

Recording heads are categorized into two major types. One is a recording head that is moved in a main scanning direction, which is a direction orthogonal to a direction in which a recording medium is conveyed. The other is a recording head that remains stationary and is not moved in the main scanning direction. A typical inkjet printer includes a plurality of recording heads, each ejecting ink of different colors.

Ink droplets are sometimes not discharged normally from nozzles in the recording head due to failure of an actuator, dust attached to the nozzle, etc. The quality of an image formed on a recording medium is degraded as a result. Such nozzle that cannot discharge ink droplets normally is referred to as a "defective nozzle" hereinafter. For this reason, a typical inkjet printer is provided with a system or a mechanism that enables one to check whether ink droplets are discharged appropriately from each nozzle.

Images are categorized into two groups. One is a binary image whose pixel color is expressed by two values. The other is a multilevel image whose pixel color is expressed by multiple values. Color density varies depending on a size of ink droplets. Most inkjet printers are capable of discharging different sizes of ink droplets to process a multilevel image.

Image data of a multilevel image is data of a group of pixels, each pixel expressing a color. The pixel data expresses each color in a plurality of bits. However, the number of sizes of ink droplets that the inkjet printer can discharge usually smaller than the number of tone levels that the pixel data express for each color. For this reason, most inkjet printers perform color quantization to reduce the number of tone levels for each color and discharges ink droplets of the same type to different positions multiple times to reproduce the color of one pixel. A part that is formed by one discharge of an ink droplet is referred to as a "dot" hereinafter, in order to distinguish it over a pixel.

Assuming that the number of gradations formed by different sizes of ink droplets is 16 for each color while the number of tone levels expressed by pixel data is 256 for each color, the color of one pixel is reproduced by discharging ink droplets sixteen (=256/16) times for each color. Assuming that an inkjet printer capable of discharging ink of four colors discharges ink of each color to different positions, the color of one pixel is reproduced by sixty-four discharges of ink. Accordingly, one pixel may be expressed by a block constituted by 64 (=8×8) dots. This block of 8×8 dots is composed of a group of 16 sub-blocks, each being constituted by 4 (2×2) dots.

When color quantization is performed to reduce the number of tone levels from 256 to 16, a large error is likely to occur due to the quantization. Thus, by compounding, the error of the entire formed image may be too large to ignore. To address this issue, various operations of reducing the error of the entire formed image are performed, one of which is error diffusion.

Error diffusion is an operation in which an error that occurs due to color quantization is distributed to neighboring pixels to minimize the error of an entire image. Specifically, the inkjet printer as described above in which one piece of pixel data in image data is expressed by the block of 8×8 dots performs error diffusion in units of the sub-block constituted by 2×2 dots.

An inkjet printer repeats printing on a row-by-row basis to form an image on a recording medium. The row is a series of dots aligning in the main scanning direction, referred to as a "line" hereinafter. When there is a defective nozzle in the recording head that moves in the main scanning direction, ink droplets are not discharged where the defective nozzle supposed to discharge ink droplets.

SUMMARY

Disclosed herein is a method for processing image data for recording by an image forming apparatus that discharges ink droplets from a plurality of nozzles. The method includes reading out image data corresponding to one line constituted by a series of dots aligning in a main scanning direction. The method further includes calculating a faulty discharge error, which occurs at a non-discharge position on a line at which no ink droplet is discharged from a defective one of the plurality of nozzles. The method further includes controlling distribution of the faulty discharge error to a line that is downstream relative to a line on which the non-discharge position occurs according to a limit setting that limits distribution of the faulty discharge error.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 4 is an illustration for describing an amount of error distribution according to the related art;

FIG. 5 is an illustration for describing an amount of error distribution according to an embodiment of the present disclosure;

Figure 1:
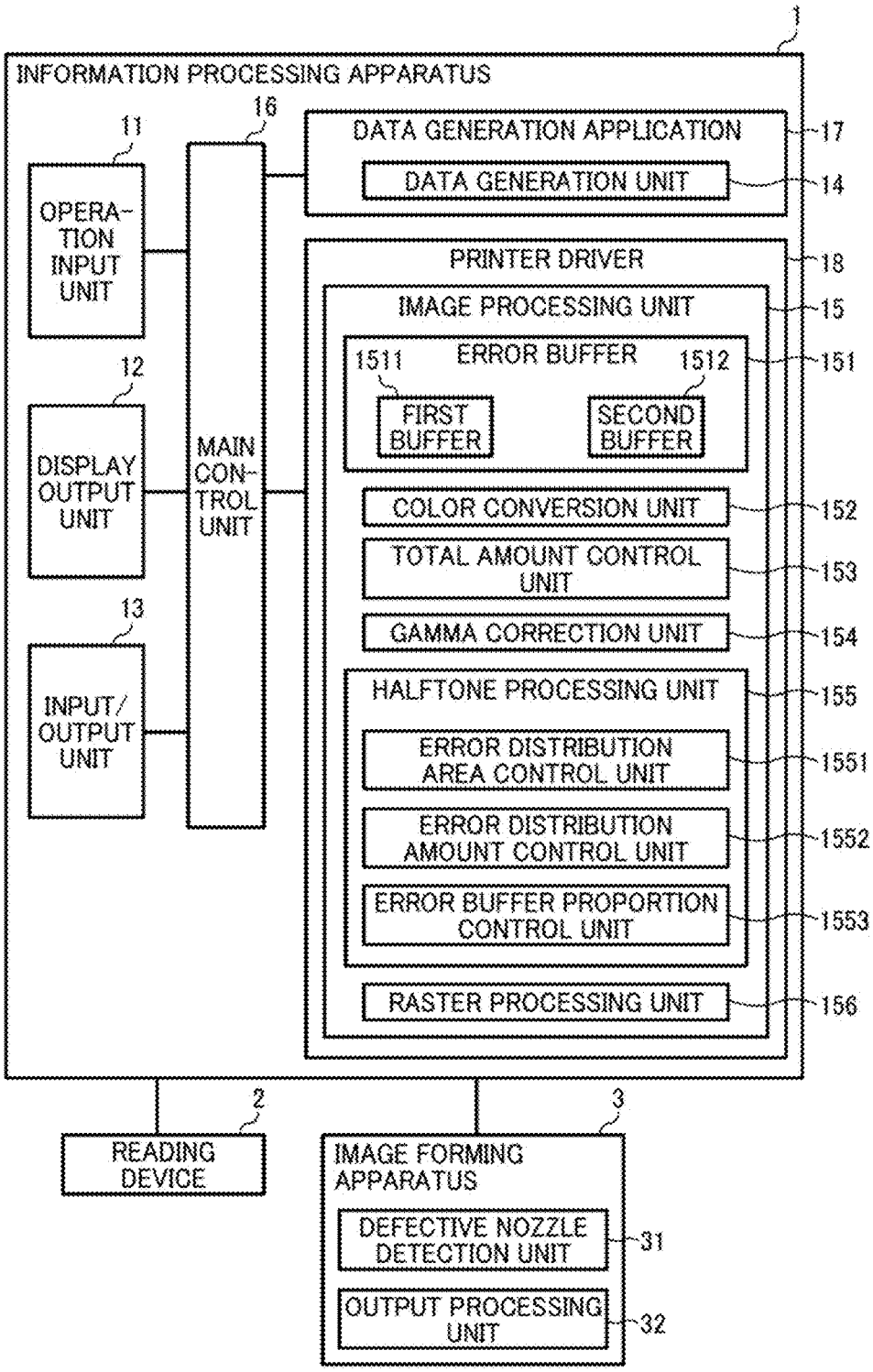
FIG. 1 is a block diagram illustrating an example configuration of an image forming system according to an embodiment of the present disclosure.

The accompanying drawings are intended to depict embodiments of present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the multiple forms as well, unless the context clearly indicates otherwise.

An embodiment of the present disclosure is described hereinafter with reference to drawings. FIG. 1 is a block diagram illustrating a configuration of an image forming system according to an embodiment of the present disclosure. As illustrated in FIG. 1, the image forming system according to this embodiment includes an information processing apparatus 1, a reading device 2, and an image forming apparatus 3, which are connected to one another. An image processing apparatus according to this embodiment is installed in the information processing apparatus 1.

The reading device 2 is, for example, a scanner that reads an image formed on a recording medium or an apparatus equipped with the scanner. The present disclosure is described based on the assumption that image formation on the recording medium is performed using data acquired from the reading device 2. Alternatively, the reading device 2 may be a device that stores another type of data, such as document data from which data an image to be formed on the recording medium is generated.

Figure 2:
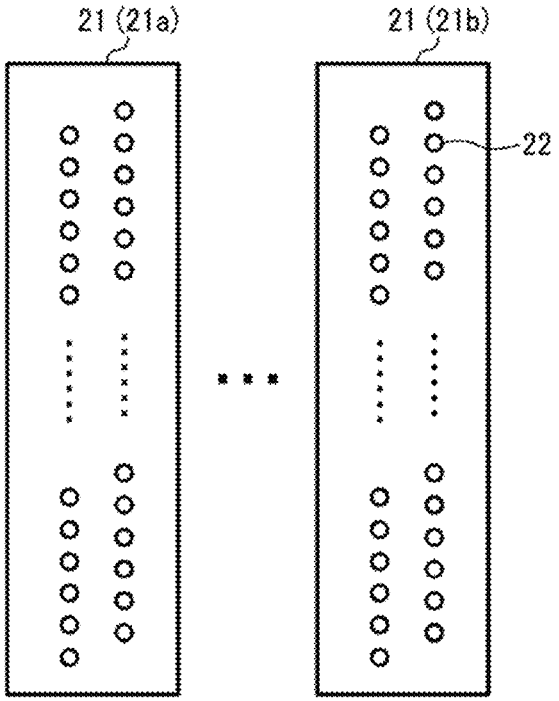
FIG. 2 is an illustration for describing a recording head of an image forming apparatus according to an embodiment of the present disclosure.

The image forming apparatus 3 is a printing apparatus that forms an image on the recording medium. The image forming apparatus 3 discharges ink droplets onto a recording medium to form an image thereon. In order to discharge ink droplets, the image forming apparatus 3 includes recording heads 21 (21*a*, 21*b*) each having a plurality of nozzles 22 as illustrated in FIG. 2. It should be noted that although in FIG. 2 only the two recording heads 21 are illustrated, a recording head 21 is provided for each color of ink. For example, there may be four or more recording heads 21. The recording head 21 is moved in a main scanning direction, which is a direction orthogonal to a direction in which a recording medium is conveyed.

Referring again to FIG. 1, the image forming apparatus 3 includes a defective nozzle detection unit 31 and an output processing unit 32. The defective nozzle detection unit 31 detects a nozzle 22 that cannot discharge ink droplets properly from among the plurality of nozzles 22 in the recording head 21. Such nozzle 22 that cannot discharge ink droplets properly is referred to as a "defective nozzle 22" hereinafter. The output processing unit 32 outputs a detection result of the defective nozzle 22 to the information processing apparatus 1.

For example, the defective nozzle detection unit 31 optically checks ink droplets discharged from the nozzles 22 to detect the defective nozzle 22. Alternatively, the defective nozzle detection unit 31 may specify the state of discharge of ink droplets based on an operation of an actuator for discharging the ink droplets. These are just examples of an operation performed by the defective nozzle detection unit 31, and the defective nozzle detection unit 31 may perform any other operation, provided that it detects a defective nozzle 22.

The information processing apparatus 1 is implemented by, for example, a computer such as a personal computer. The information processing apparatus 1 controls the image forming apparatus 3 to form an image on a recording medium. As illustrated in FIG. 1, the information processing apparatus 1 includes functional blocks such as an operation input unit 11, a display output unit 12, an input/output unit 13, a data generation unit 14, an image processing unit 15, and a main control unit 16.

The operation input unit 11 analyzes a user operation to an input device to recognize various instructions or input data. The input device is implemented by a keyboard, a touch panel, and a pointing device, etc. This input device collectively refers to an input device installed in the information processing apparatus 1 or an input device connected to the information processing apparatus 1.

The display output unit 12 outputs an image to a display. The display is installed in the information processing apparatus 1 or connected to the information processing apparatus 1.

The input/output unit 13 enables the information processing apparatus 1 to communicate with an external device via an interface. The information processing apparatus 1 communicates with the reading device 2 and the image forming apparatus 3 via the input/output unit 13.

The data generation unit 14 generates image data, which is data of an image to be formed by the image forming apparatus 3. The data generation unit 14 implements input of image data from the reading device 2, editing of the image data, input of data from which image data is generated, editing of the data from which image data is generated, printing of the image data, etc. These functions are provided by a data generation application 17, which is an application program. The data generation application 17 itself may be implemented by any desired application.

The image processing unit 15 controls the image forming apparatus 3. The image processing unit 15 generates data for image formation by the image forming apparatus 3 from the image data whose printing is instructed by the data generation unit 14. The image processing unit 15 is a function provided by a printer driver 18 that can operate on the image forming apparatus 3. As illustrated in FIG. 1, the image processing unit 15 includes functional blocks such as an error buffer 151, a color conversion unit 152, a total amount control unit 153, a gamma correction unit 154, a halftone processing unit 155, and a raster processing unit 156.

The information processing apparatus 1 supports full colors in which each color is expressed in bits of 8 or more (256 or more levels of tone). The image forming apparatus 3 varies a size of ink droplets of each color to reproduce a color. However, the number of sizes of ink droplets that the image forming apparatus can discharge is smaller than the number of colors that the information forming apparatus supports. Accordingly, an error due to color quantization occurs in image formation (printing) by the image forming apparatus 3. In this embodiment, a description is given on the assumption that the error of an entire image is corrected by error diffusion. The error buffer 151 is used for storing an error to be distributed.

The error buffer 151 includes a first buffer 1511 and a second buffer 1512. The first buffer 1511 is provided for distributing an error that occurs due to color quantization. The second buffer 1512 is provided for distributing an error that occurs due to the defective nozzle 22. Hereinafter, an error that occurs due to color quantization is referred to as a "color quantization error", whereas an error that occurs due to the defective nozzle 22 is referred to as a "faulty discharge error", in order to simplify the description.

The information processing apparatus 1 processes image data that express a color using three primary colors such as red, green, and blue (RGB). By contrast, the image forming apparatus 3 expresses a color using ink that the image forming apparatus 3 can use. More specifically, the image forming apparatus expresses a color using ink of four colors, e.g., cyan, magenta, yellow, and black (CMYK). Because the colors used by the information processing apparatus to express a color are different those of the image forming apparatus 3, the color conversion unit 152 converts image data whose color is expressed by RGB to image data whose color is expressed by CMYK. Hereinafter, the image data whose color is expressed by RGB is referred to as "RGB image data", and the image data whose color is expressed by CMYK is referred to as "CMYK image data", in order to simplify the description.

The CMYK image data generated by the color conversion unit 152 corresponds to the RGB image data. In addition, the CMYK image data is required to be data that the image forming apparatus 3 can process. In other words, a value of each color component of CMYK is required not to exceed an upper limit that the image forming apparatus 3 can process. For this reason, the total amount control unit 153 processes the CMYK image data generated by the color conversion unit 152 such that a value of each color component of CMYK of each pixel is less than or equal to the upper limit.

The gamma correction unit 108 performs gamma correction on the CMYK image data in order to make images appear more natural. The halftone processing unit 155 performs error diffusion on the CMYK image data on which gamma correction has been performed to determine each pixel data, that is, to determine a value of each color component of each pixel.

In error diffusion, an error that occurs in a line is distributed to another line. In this disclosure, the term "line" indicates a series of dots aligning in a main scanning direction. The defective nozzle 22 causes the error. For this reason, the halftone processing unit 155 references the detection result detected by the defective nozzle detection unit 31 of the image forming apparatus 3. The halftone processing unit 155 references the detection result to recognize a defective line, which is a line on which ink droplets are not discharged from the defective nozzle 22.

Hereinafter, the relative positions of distinct lines are described based on the sub-scanning direction, which is a direction in which a recording medium is conveyed. For example, a "next line to a defective line" means a line that is downstream relative to the defective line in the sub-scanning direction.

The halftone processing unit 155 converts the CMYK image data on which gamma correction has been performed to CMYK image data having the number of tone levels that the image forming apparatus 3 can process. As illustrated in FIG. 1, the halftone processing unit 155 includes an error distribution area control unit 1551, and an error distribution amount control unit 1552, and an error buffer proportion control unit 1553.

The error distribution area control unit 1551 controls an area in which the faulty discharge error is to be distributed. The area in which the faulty discharge error is distributed is referred to as a "distribution area" hereinafter. The error distribution amount control unit 1552 controls a faulty discharge error to be distributed.

The faulty discharge error is an error that occurs due to the defective nozzle 22. In addition to the faulty discharge error, there is the color quantization error to be distributed. In this embodiment, error distribution is performed incorporating the color quantization error. The error buffer proportion control unit 1553 calculates an error to be actually distributed incorporating the color quantization error according to settings.

A detailed description is given of the error distribution area control unit 1551, the error distribution amount control unit 1552, and the error buffer proportion control unit 1553 with reference to FIGS. 4 to 8.

FIG. 4 is an illustration for describing an amount of error distribution according to the related art. FIG. 5 is an illustration for describing an amount of error distribution according to this embodiment. In FIGS. 4 and 5, a line number is assigned to each line for the description. Further, FIGS. 4 and 5 each illustrates a state of each line and an error to be distributed using error diffusion. The error to be distributed using error diffusion is referred to as a "distribution error" hereinafter. First, a description is given of controlling the distribution area performed by the error distribution area control unit 1551.

In examples of FIGS. 4 and 5, the state of each line is categorized into two types. One is a defective line, which is a line on which ink droplets are not discharged from the defective nozzle 22. The other one is a discharge line. The distribution error is categorized into three types, that is, a "color quantization error", "no error or large error", and "large error". The "color quantization error" indicates an error that occurs due to color quantization. The "large error" indicates a faulty discharge error that occurs due to the defective line.

An error due to the defective nozzle 22 can be corrected by causing another nozzle 22 to discharge ink droplets. In this case, the error is distributed to the same line. In a case in which the other nozzle 22 is not caused to discharge ink droplets, the error is not distributed. "No error or large error" illustrated in connection with the defective line indicates an error to be distributed that changes depending on whether the other nozzle 22 is caused to discharge ink droplets.

As illustrated in FIG. 4, the error (large error) that occurs due to the defective line is partly distributed to the next line below, and the rest part of the error is distributed to lines subsequent to the next lines. Accordingly, ink droplets having a size that makes a color of dot darker are discharged on a line next to the defective line and further below lines. As a result, color reproducibility is degraded in a large area of lines, and thereby the entire image quality is further degraded.

By contrast, as illustrated in FIG. 5, in this embodiment, the error distribution area control unit 1551 places a limit on the number of lines to which an error that occurs due to the defective line is distributed. FIG. 5 illustrates a case in which the error distribution area control unit 1551 controls the error that occurs due to the defective line to be distributed only to the next line below.

When such limit is placed on an area to which the error is distributed, the number of lines exhibiting low color reproducibility decreases, compared with a case in which no limit is placed on the area to which the error is distributed. Accordingly, a line or lines exhibiting low color reproducibility is less perceptible to human observation. Thus, degradation of entire image quality due to the occurrence of the defective line is suppressed.

The larger an error that occurs in the defective line, the larger area to which the error is distributed. This leads to severe degradation of color reproducibility of each line in that area. To address this issue, in this embodiment, the error distribution amount control unit 1552 manipulates an error to be distributed, and thereby controls an error distributed to a line next to the defective line and lines subsequent to the next line.

The error distribution amount control unit 1552 calculates an error to be distributed (distribution error) using the following equation (1).

$$TE=RE\times r, \quad \text{Equation (1):}$$

where TE denotes the distribution error, RE denotes an error that actually occurred, and r denotes a control amount. The value of r is $0<r\leq 1$. Thus, the error distribution amount control unit 1552 controls the distribution error TE to be less than or equal to the error RE depending on the error RE.

The control amount r is a variable that is varied depending the error RE. The value of r is obtained using the following equation (2).

$$aX+b, \quad \text{Equation (2):}$$

where X denotes the error RE or a value obtained from the error RE (for example, a value corresponding to a size of ink droplets), and "a" and "b" are both constants.

It should be noted that Equation (1) is just one example, and the distribution error TE may be calculated using any other suitable equation. For example, the distribution error TE may be obtained using the following equation (3).

$$TE=RE-r \quad \text{Equation (3):}$$

In addition, the control amount r may be calculated using any other suitable equation, instead of equation (2). For example, the control amount r may be obtained using the following equation (4) or equation (5).

$$r=aX^2+bX+c; \quad \text{Equation (4):}$$

$$r=aX^3+bX^2+cx+d, \quad \text{Equation (5):}$$

where c and d are both constants.

It should be noted that the control amount r and the distribution error TE may be obtained using a lookup table (LUT) instead of an equation. Any desired lookup table may be used to obtain the control amount r and the distribution error.

When the distribution error obtained as described above is distributed, an area of lines in which the reproducibility of color is degraded is suppressed as well as a degree of the degradation. Thus, degradation of entire image quality due to the occurrence of the defective line is also suppressed.

The distribution error TE is calculated for each pixel. The calculated distribution error TE is stored in the second buffer 1512 of the error buffer 151. In a case in which no control is performed on the amount of error to be distributed, the error RE is stored in the second buffer 1512 as the distribution error TE.

Figure 6:
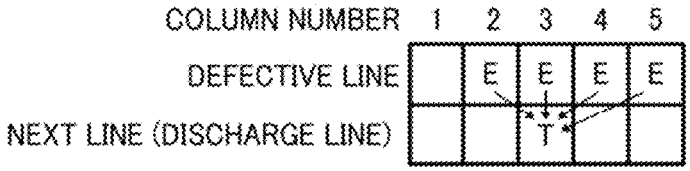
FIG. 6 is an illustration for describing an error to be distributed to a target pixel using an error stored in a second buffer according to an embodiment of the present disclosure.
Figure 7:
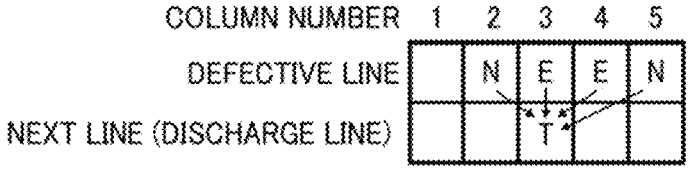
FIG. 7 is an illustration for describing an error to be distributed to a target pixel using an error stored in a first buffer and an error stored in the second buffer according to an embodiment of the present disclosure.

FIG. 6 is an illustration for describing an error or errors to be distributed to a target pixel using an error stored in the second buffer 1512. FIG. 7 is an illustration for describing an error or errors to be distributed to a target pixel using the first buffer 1511 and the second buffer 1512.

In FIGS. 6 and 7, "E" represents an error stored in the second buffer 1512, "N" represents an error stored in the first buffer 1511, and "T" represents a target pixel. A "column number" in FIGS. 6 and 7 is information for identifying a column, which is a series of pixels aligning in a sub-scanning direction.

As illustrated in FIGS. 6 and 7, an error in a pixel on the next line above or an error in each of four neighboring pixels is distributed to the target pixel T. If an error stored in the second buffer 1512 for each of the four neighboring pixels is distributed to the target pixel T as illustrated in FIG. 6, the color component value of each of CMYK of the target pixel T is usually changed greatly. This is because the error stored in the second buffer 1512 is usually larger than that stored in the first buffer 1511. It should be noted the number of pixels used in the error diffusion operation is not limited to four, and any desired number of pixels may be used.

By contrast, when an error stored in the first buffer 1511 for each of the four neighboring pixels is distributed to the target pixel T as illustrated in FIG. 7, a total value of errors distributed to the target pixel T is suppressed. Because an error stored in the first buffer 1511 is an error distributed prior to the defective line, the continuity of error is reflected on the distribution of error. Thus, image quality is maintained.

The error buffer proportion control unit 1553 distributes errors to the target pixel T as illustrated in FIG. 7 in the distribution area controlled by the error distribution area control unit 1551 to determine each CMYK value of the target pixel T. By contrast, the error buffer proportion control unit 1553 distributes errors to the target pixel T as illustrated in FIG. 6 referring to only the first buffer 1511 in an area outside the distribution area controlled by the error distribution area control unit 1551. Thus, in this embodiment, the degradation of image quality due to the distribution of the faulty discharge error caused by occurrence of the defective line is suppressed by controlling the distribution area, manipulating the error to be distributed in the defective line, and reflecting the error stored in the first buffer 1511.

Figure 8A:
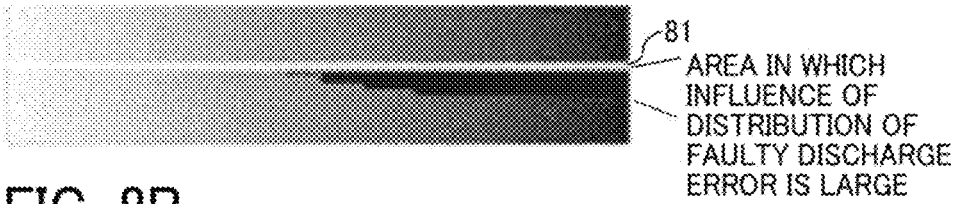
FIG. 8A RELATED ART
FIGS. 8A to 8C are illustrations for describing variation in an image depending on distribution of an error on a defective line according to an embodiment of the present disclosure.
Figure 8B:
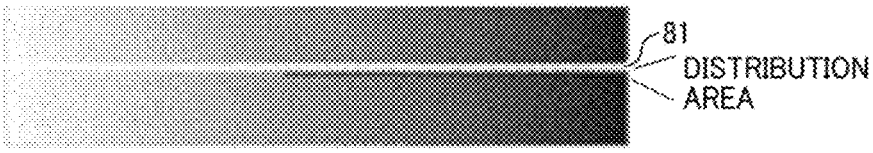
Figure 8C:
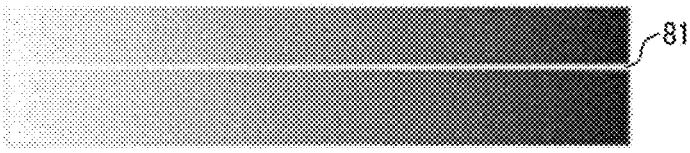

FIGS. 8A to 8C are illustrations for describing variation in an image depending on control of distribution of the error of the defective line. FIG. 8A is an illustration according to the related art, in which no control is performed on the distribution of error. FIGS. 8B and 8C are example illustrations according to this embodiment. More specifically, FIG. 8B illustrates a case in which the distribution area is set. FIG. 8C illustrates a case in which a limit is placed on an amount of error to be distributed, that is, the faulty discharge error is manipulated using Equation (1), for example.

The image forming apparatus includes the plurality of recording heads 21, each ejecting ink of different colors. Accordingly, even when the defective nozzle 22 occurs in one of the plurality of recording heads 21, it hardly happens that no ink droplet is discharged on an entire line. However, FIGS. 8A to 8C each illustrates a part of image with emphasis on a defective line 81.

The occurrence of the defective 81 usually produces a large faulty discharge error. Accordingly, as illustrated in FIG. 8A, an area in which an influence of distribution of faulty discharge error is significant becomes large, when no control is performed on the distribution of faulty discharge error. As a result, the defective line 81 and the area in which the influence of distribution of faulty discharge error is significant are easily noticeable, and thereby image quality is severely degraded.

According to the related art, in order to suppress such degradation of image quality due to the distribution of large error, compensation processing to be applied is switched depending on the density of color of dot to be formed by the defective nozzle. More specifically, according to the related art, a compensation processing using error diffusion in which an error is distributed to neighboring dots is performed, when the dot color is relatively light. When the dot color is relatively dark, a compensation processing using a mask pattern processing is performed. In the mask pattern processing, a size of ink droplet to be discharged at each of dots in the vicinity of the dot to be formed by the defective nozzle is changed by pattern matching using a mask pattern prepared in advance.

The mask pattern processing is perforated to sufficiently compensate a relatively large error that occurs due to the defective nozzle. When the two types of compensation processing are switched therebetween, a boundary portion that is formed when the compensation processing is switched becomes noticeable. Thus, the entire image quality is degraded.

By contrast, as illustrated in FIG. 8B, when a limit is placed on an area to which the error is distributed, the influence of distribution of faulty discharge error is significant only in the distribution area. Accordingly, the area in which the influence of distribution of faulty discharge error is significant is less noticeable. As a result, degradation of image quality is suppressed.

Further, when an amount of error to be distributed is controlled, a variation of color density due to the distribution of faulty discharge error is suppressed. Accordingly, as illustrated in FIG. 8C, the area in which the influence of distribution of faulty discharge error is significant is prevented from occurring. Thus, degradation of image quality is suppressed.

The halftone processing unit 155 processes CMYK image data on a line-by-line basis, for example. Accordingly, the error buffer proportion control unit 1553 generates CMYK image data on which the operation of distributing an error has been performed on a line-by-line basis. The generated CMYK image data is output to the raster processing unit 156. In this embodiment, a description given on the assumption that the CMYK image data is processed on a line-by-line basis.

The raster processing unit 156 performs raster processing on the input CMYK image data to enable the image forming apparatus 3 to discharge ink droplets to form an image. The image data having a raster format generated by the raster processing is output to the image forming apparatus 3 through the main control unit 16 and the input/output unit 13.

One pixel in the RGB image data corresponds to a plurality of dots in the image forming apparatus 3. More specifically, the one pixel corresponds to a block constituted by 8×8 dots. In other words, the sizes of ink droplets of each color that form the plurality of dots are determined substantially by processing one pixel. For this reason, in this embodiment, the processing of distributing an error using error diffusion is performed on the CMYK image data. Alternatively, this processing of distributing an error may be performed on image data having a raster format that can be used directly in forming dots.

The main control unit 16 controls an entire operation of the information processing apparatus 1. More specifically, the main control unit 16 controls each of the functional blocks 11 to 15 in accordance with a user instruction recognized by the operation input unit 11. Accordingly, the user is able to generate or obtain desired image data or instruct the image forming apparatus 3 to form an image.

Figure 3:
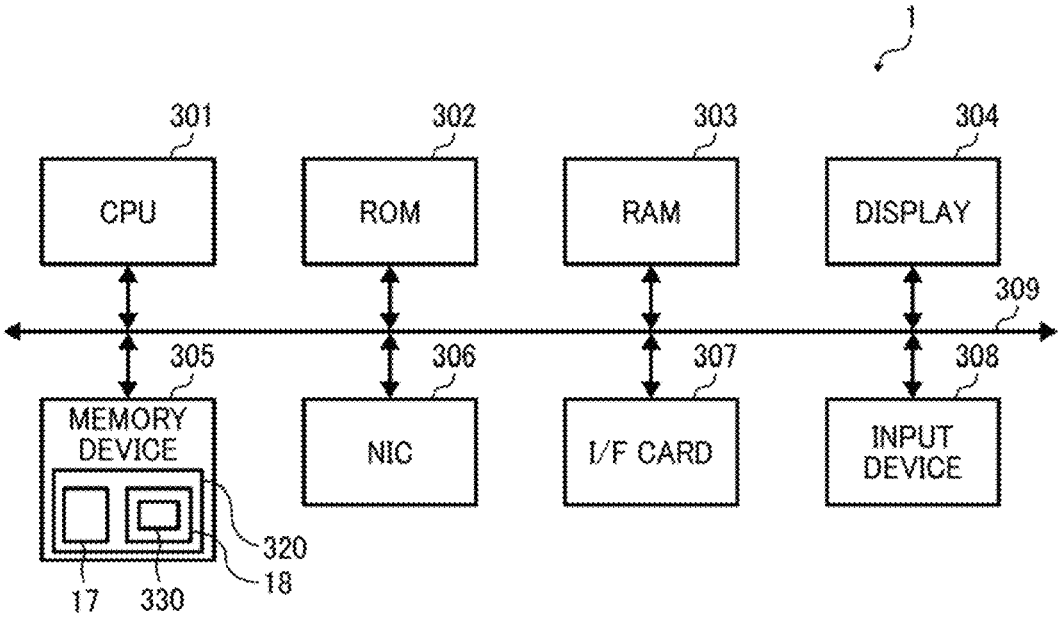
FIG. 3 is a block diagram illustrating an example hardware configuration of an information processing apparatus according to an embodiment of the present disclosure.

FIG. 3 is a diagram illustrating a hardware configuration of the information processing apparatus 1 as example of an image processing apparatus according to this embodiment. Hereinafter, a description is given of the hardware configuration of the information processing apparatus 1 with reference to FIG. 3.

In FIG. 3, the same reference numbers are allocated to elements (members or components) having the same function. In particular, the reference number "1" is allocated to the information processing apparatus in FIG. 3. In addition, the data generation application 17 and the printer driver 18 are illustrated to clarify where they reside.

As illustrated in FIG. 3, the information processing apparatus 1 includes a central processing unit (CPU) 301, a read only memory (ROM) 302, a random access memory (RAM) 303, a display 304, a memory device 305, a network interface card (NIC) 306, an interface card 307, an input device 308, and a bus 309. The configuration illustrated in FIG. 3 is just an example, and any desired configuration may be applied to the information processing apparatus 1.

The ROM 302 is a read-only non-volatile storage medium that stores firmware and various data. The RAM 303 is a high-speed read/write volatile storage medium. The CPU 301 uses the RAM 302 as a work area in processing data.

The display 304 is installed in the information processing apparatus 1. The display 304 is implemented by a liquid crystal display, for example. The memory device 305 includes one or more nonvolatile storages such as a hard disk drive and a solid state drive (SSD). The memory device 305 includes a storage medium 320. The storage medium 320 stores various programs such as an operating system (OS), applications, and drivers. The programs stored in the storage medium 320 include the data generation application 17 and the printer driver 18.

The NIC 306 is a communication device that enables communication through a network. The information processing apparatus 1 acquires image data and data from which the image data is generated from an external device other than the reading device 2 through the NIC 306.

In this embodiment, the interface card 307 is a communication device that enables the information processing apparatus 1 to communicate with external devices including the reading device 2 and the image forming apparatus 3. The input device 308 installed in the information processing apparatus 1. Examples of the input device 308 include a keyboard and a pointing device.

The operation input unit 11 illustrated in FIG. 1 analyzes a user operation to the input device 308 to enable a user to input instructions and various data. The function of the operation input unit 11 is implemented by the CPU 301 executing the OS. Accordingly, the operation input unit 11 is implemented by, for example, instructions from the CPU 301 and by the ROM 302, the RAM 303, the memory device 305, and the bus 309.

The display output unit 12 illustrated in FIG. 1 enables the display 304 to display an image. The function of the display output unit 12 is implemented by the CPU executing the OS. Accordingly, the display output unit 12 is implemented by, for example, instructions from the CPU 301 and by the ROM 302, the RAM 303, the memory device 305, and the bus 309.

The input/output unit 13 is implemented by the NIC 306 and the interface card 307, when operating under control of the CPU 301 executing the OS. Accordingly, the input/output unit 13 is implemented by, for example, instructions from the CPU 301 and by the ROM 302, the RAM 303, the memory device 305, the NIC 306, the interface card 307, and the bus 309.

The data generation application 17 is implement by the CPU 301 executing the data generation application 17. The image processing unit 15 is implemented by the CPU 301 executing the printer driver 18. Accordingly, each of the data generation unit 14 and the image processing unit 15 is implement by, for example, the instructions from the CPU 301 and by the ROM 302, the RAM 303, the memory device 305, and the bus 309.

The error buffer 151 is a work area set aside in the memory device 305 or the RAM 303. Alternatively, the error buffer 151 is two or more array variables. For example, the error of each pixel stored in the error buffer 151 is usually stored in the RAM 303.

The main control unit 16 is implemented by the CPU 301 executing the OS. Accordingly, the main control unit 16 is implemented by for example, instructions from the CPU 301 and by the ROM 302, the RAM 303, the memory device 305, and the bus 309.

Recognition of the defective line is performed based on the detection result of the defective nozzle 22 and the CMYK image data. This is because the nozzle 22 (color of ink) that discharges ink droplets onto each line is specified by referring to the CMYK image data. For this reason, the halftone processing unit 155 controls the distribution of error due to the defective line.

The halftone processing unit 155 is implemented by the CPU 301 executing a dedicated program 330 that is included in the printer driver 18 as a subprogram. The dedicated program 330 is referred to as a "halftone processing program 330" hereinafter. Hereinafter, a description is given of halftone processing implemented by the CPU 301 executing the halftone processing program 330 with reference to a flowchart of FIG. 9.

As described above, the halftone processing unit 155 inputs and processes the CMYK image data, on which gamma correction has been performed, on a line-by-line basis. Accordingly, in halftone processing, the CMYK image data is processed for each line at a time. Because the CMYK image data is a target of halftone processing, the processing is performed on a pixel-by-pixel basis instead of a dot-by-dot basis. A description is given of steps in the flowchart of FIG. 9 assuming that the distribution area is one line, that is, an error that occurred on a defective line is distributed to only the next line.

Figure 9:
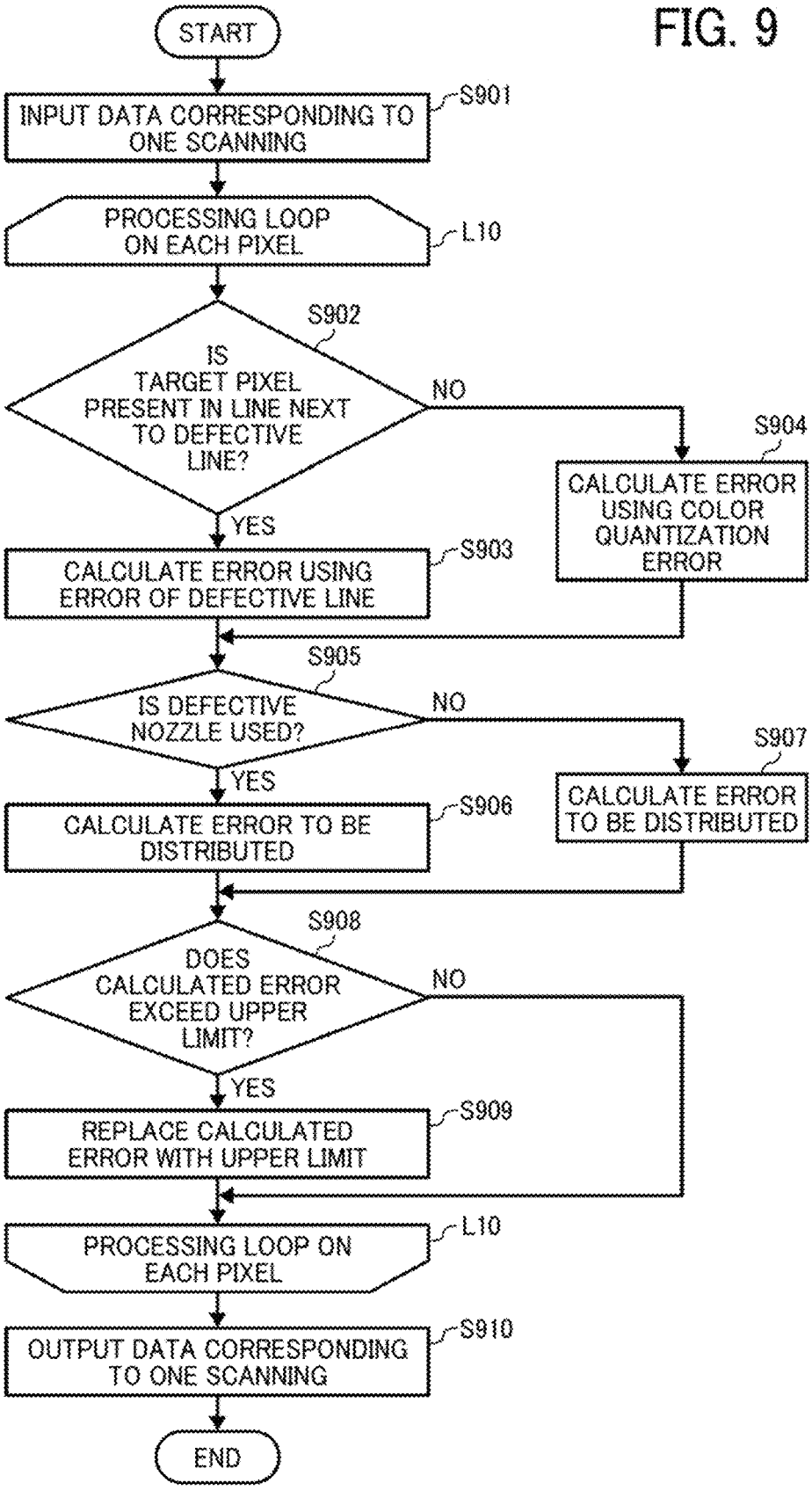
FIG. 9 is a flowchart illustrating a halftone processing according to an embodiment of the present disclosure.

The distribution of error is performed for each of color components of CMYK. When the defective nozzle 22 occurs, ink droplets of a different color may be discharged from another nozzle to compensate for ink droplets that were supposed to be discharged from the defective nozzle 22, and thereby degradation of image quality is suppressed. However, a description is given of steps in the flowchart of FIG. 9 assuming that the ink droplets of a different color are not discharged to compensate for the ink droplets that were supposed to be discharged from the defective nozzle 22, in order to simplify the description. Based on such assumption, the processing performed for one color component is the same or substantially the same as that performed for each of other color components. Accordingly, the flowchart of FIG. 9 illustrates an operation performed for one arbitrary color. A description is also given of steps in an operation performed for one arbitrary color.

When control is passed to the halftone processing program 330, the CPU 301 inputs the CMYK image data corresponding to one line, that is, one scanning (S901). After S901, the CPU 301 performs a processing loop L10 of processing the input CMYK image data on a pixel-by-pixel basis.

In the processing loop L10, the CPU 301 firstly selects one piece of pixel data as a target pixel to be processed and determines whether the target pixel resides on a line next to a defective line (S902). When the target pixel resides in the line next to the defective line (S902: YES), the operation proceeds to S903.

At S903, the CPU 301 calculates an error to be distributed using a faulty discharge error stored in the second buffer 1512. Alternatively, the CPU 301 calculates an error to be distributed using both the faulty discharge error stored in the second buffer 1512 and a color quantization error stored in the first buffer 1511. Then, the operation proceeds to S905.

The operation of calculating an error is described as an instruction in the halftone processing program 330. The CPU 301 executes the halftone processing program to calculate an error according to the described instruction. Alternatively, the operation of calculating an error may be selected based on data (limit setting) referred to by the halftone processing program 330. As the data (limit setting) is to be changed, the data may be stored in the memory device 305.

By contrast, when the target pixel resides on a line different from the line next to the defective line (S902: NO), the operation proceeds to S904. At S904, the CPU 301 calculates an error to be distributed using a color quantization error stored in the first buffer 1511. Subsequently, the operation proceeds to S905.

With the processing of calculating the error at S903 or S904, a content (a value of each color component) of the target pixel is determined. The determined value of each color component is required to correspond to the number of tone levels that the image forming apparatus 3 supports. Accordingly, at S903 and S904, color quantization is performed to convert the value of each color component to a value expressed by 2 bits.

As described heretofore, an error is calculated in two different ways depending on the determination result at S902. Thus, the error of the defective line is distributed only in the distribution area. In other words, the error distribution area control unit 1551 is implemented by the determination processing at S902. Further, the error buffer proportion control unit 1553 is implemented by the processing at S903 and S904.

At S905, the CPU 301 determines whether the target pixel is supposed to be formed by ink droplets discharged from the defective nozzle 22. When the target pixel is formed by ink droplets from the defective nozzle 22 (S905: YES), the operation proceeds to S906. By contrast, when the target pixel is formed by ink droplets from a nozzle other than the defective nozzle 22 (S905: NO), the operation proceeds to S907.

At S906, the CPU 301 calculates an error to be distributed on the defective line. Specifically, the CPU 301 obtains the error RE or the distribution error TE in Equation (1), and these errors are stored in the second buffer 1512. After calculating the error at S906, the operation proceeds to S908.

At S907, the CPU 301 calculates an error to be distributed using a result of color quantization. After calculating the error at S907, the operation proceeds to S908.

The error calculated at S906 is an error stored as an initial value in the second buffer 1512. The error calculated at S907 is an error stored as an initial value in the first buffer 1511 or an updated error. However, in a case in which the distribution area is two or more lines, an error to be distributed to a line next to the defective line and lines subsequent to the next line is updated by the calculation at S907.

At S908, the CPU 301 determines whether the error obtained at S906 or S907 exceeds a predetermined upper limit. When the error exceeds the upper limit (S908: YES), the operation proceeds to S909. At S909, the CPU 301 replaces the obtained error with the upper limit. Thus, a series of steps of the processing loop L10 ends. By contrast, when the obtained error does not exceed the upper limit (S908: NO), a series of steps of the processing loop L10 ends.

In Equation (1), the larger the error RE, the larger the distribution error TE. Accordingly, even when the distribution error TE is distributed, color reproducibility in the distribution area may be deteriorated severely. When the upper limit is placed on the error to be distributed, the degradation of color reproducibility may be suppressed. For this reason, in this embodiment, an upper limit is placed on an error to be distributed. Thus, the error to be distributed is less than or equal to the upper limit regardless of a type of the error, i.e., regardless of whether the distribution error TE or the error RE is set as the faulty discharge error. The error distribution amount control unit 1552 is implemented by the processing of S905 to S909.

The processing loop L10 is repeated until all the pieces of pixel data constituting the input CMYK image data corresponding to one line are processed. When all the pieces of pixel data are processed, the operation proceeds from the processing loop L10 to S910.

At S910, the CPU 301 outputs the CMYK image data corresponding to one line on which the operation of distributing an error has been performed. Then, the halftone processing ends. The output CMYK image data is converted to image data of a raster format and output to the image forming apparatus 3.

It should be noted that the upper limit may be changeable because the degree of image quality degradation due to a distributed error varies depending on a content of image. For the similar reason, an equation or a LUT for calculating the distribution error TE, and the distribution area may be also changeable depending on a content of an image and the preference of a user for example. For example, the number of lines as the distribution area may be zero, or two or more.

In this embodiment, as described heretofore, the distribution of the faulty discharge error is controlled through three types of processing. The first one is placing a limit on the distribution area. The second one is manipulating the faulty discharge error (calculating the distribution error TE and placing an upper limit). The third one is incorporating the color quantization error. The degradation of image quality can be suppressed through even either one of these three types of processing for control. Further, in manipulating the faulty discharge error, the degradation of image quality can be suppressed by calculating the distribution error TE and distributing the calculated distribution error as the faulty discharge error even when the upper limit is placed on the error to be distributed. Alternatively, the degradation of image quality can be also suppressed by only placing the upper limit on the error to be distributed even when the distribution error is not calculated for distribution. Thus, at least one of the three types of processing for control may be performed. The processing to be performed may be arbitrarily changed A setting (limit setting) of these three types of processing is implemented by the coding of printer driver 18 or data that is referred to by the halftone processing program 330. The coding of printer driver 18 provides less flexibility in setting the three types of processing for controlling the distribution of faulty discharge error. Accordingly, the printer driver 18 may configure the setting (limit setting) for the three types of processing through the data that is referred to by the halftone processing program 330.

The image processing apparatus according to this embodiment is implemented by the halftone processing unit 155 installed in the information processing apparatus 1 in a narrow sense. In other words, the image processing apparatus according to this embodiment is implemented by the information processing apparatus 1 executing the halftone processing program 330 in the printer driver 18. The halftone processing program 330 corresponds to a program according to this embodiment in a narrow sense.

The halftone processing unit 155 may be installed in the image forming apparatus 3. Alternatively, the halftone processing unit 155 may be installed in another information processing apparatus that can communicate with the information processing apparatus 1. The other information processing apparatus including the halftone processing unit 155 may be used as necessary. Accordingly, the halftone processing program 330 or a program including the halftone processing program 330 as a subprogram may be stored in another storage medium different from the storage medium 320 included in the memory device 305. In other words, any desired storage medium may be used for storing the halftone processing program 330 or a program including the halftone processing program 330.

The image forming apparatus 3 moves the recording head 21 in the main scanning direction to form an image on a recording medium. This means that when the nozzle 22 that is supposed to discharge ink droplets on an entire line is the defective nozzle 22, the defective line 81 as illustrated in FIGS. 8A to 8C occurs. By contrast, when a recording head that remains stationary and is not moved in the main scanning direction is used, the occurrence of the defective nozzle 22 produces a series of blank or defective dots aligned in a sub-scanning direction. Accordingly, ink droplets are not discharged in a part on the defective line.

Such faulty discharge error that occurs in a part may be distributed in a main scanning direction. The above-described three types of processing for controlling the distribution of faulty discharge error may be used for or applied to controlling the distribution of such faulty discharge error. Accordingly, the recording head 21 of the image forming apparatus 3 may be a recording head that remains stationary and is not moved in a main scanning direction.

According to an embodiment of the present disclosure, degradation of image quality due to an occurrence of the defective nozzle is suppressed.

The above-described embodiments are illustrative and do not limit the present disclosure. Thus, numerous additional modifications and variations are possible in light of the above teachings. For example, elements and/or features of different illustrative embodiments may be combined with each other and/or substituted tor each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. A method of processing image data for recording by an image forming apparatus that discharges ink droplets from a plurality of nozzles, the method comprising:

reading out image data corresponding to one line constituted by a series of dots aligning in a main scanning direction;

detecting a faulty discharge error, which occurs at a non-discharge position on a first line at which no ink droplet is discharged from a defective one of the plurality of nozzles;

storing a limit setting that limits distribution of the faulty discharge error;

controlling the distribution of the faulty discharge error to change at least one second line that is downstream relative to the first line according to the limit setting; and controlling operation of the plurality of nozzles in accordance with the distribution.

2. The method of claim 1, wherein:

the limit setting defines a distribution area in which the distribution of the faulty discharge error is to be controlled, and the controlling controls the distribution of the faulty discharge error in the distribution area defined by the limit setting.

3. The method of claim 1, wherein:

the limit setting defines a calculation to change the faulty discharge error to a smaller value than the faulty discharge error that actually occurred, and the controlling controls the distribution of the changed faulty discharge error as the faulty discharge error.

4. The method of claim 3, wherein the calculation limits the faulty discharge error to a value less than or equal to an upper limit.

5. The method of claim 1, wherein:

the limit setting defines a calculation of the distribution of the faulty discharge error using a color quantization error that occurs due to selection of a size of ink droplets to be discharged from the plurality of nozzles; and the controlling includes performing the calculation of the distribution of the faulty discharge error using the color quantization error as defined by the limit setting, and controlling the distribution of the faulty discharge error according to the calculation.

6. An image processing apparatus for processing image data for recording by an image forming apparatus that discharges ink droplets from a plurality of nozzles, the apparatus comprising circuitry to:

read out image data corresponding to one line constituted by a series of dots aligning in a main scanning direction;

detect a faulty discharge error, which occurs at a non-discharge position on a first line at which no ink droplet is discharged from a defective one of the plurality of nozzles;

store a limit setting that limits distribution of the faulty discharge error;

control the distribution of the faulty discharge error to change at least one second line that is downstream relative to the first line according to the limit setting; and control operation of the plurality of nozzles in accordance with the distribution.

7. A non-transitory computer-readable medium storing a computer-executable program that, when executed, causes an information processing apparatus to perform a method of processing image data for recording by an image forming apparatus that discharges ink droplets from a plurality of nozzles, the method comprising:

reading out image data corresponding to one line constituted by a series of dots aligning in a main scanning direction;

detecting a faulty discharge error, which occurs at a non-discharge position on a first line at which no ink droplet is discharged from a defective one of the plurality of nozzles;

storing a limit setting that limits distribution of the faulty discharge error;

controlling the distribution of the faulty discharge error to change at least one second line that is downstream relative to the first line according to the limit setting; and controlling operation of the plurality of nozzles in accordance with the distribution.

* * * * *